US005533291A

United States Patent [19]

Boland

[11] Patent Number: 5,533,291

[45] Date of Patent: Jul. 9, 1996

[54] FIREARM CAPABLE OF OPERATION WITH DIFFERENT CAPACITY MAGAZINES

[75] Inventor: James W. Boland, Vista, Calif.

[73] Assignee: Mitchell Arms Corp., Santa Ana, Calif.

[21] Appl. No.: 370,199

[22] Filed: Jan. 9, 1995

[51] Int. Cl.[6] ..... F41A 9/68

[52] U.S. Cl. ..... 42/7

[58] Field of Search ..... 42/6, 7, 18, 22, 42/49.02, 50

[56] References Cited

U.S. PATENT DOCUMENTS

| | | | |
|---|---|---|---|
| 581,296 | 4/1897 | Mannlicher | 42/7 |
| 4,332,097 | 6/1982 | Taylor | 42/50 |
| 4,586,281 | 5/1986 | Chesnut | 42/50 |
| 4,586,282 | 5/1986 | Sniezak | 42/71.02 |
| 4,759,144 | 7/1988 | Egan et al. | 42/7 |
| 4,765,081 | 8/1988 | Dieringer | 42/50 |
| 4,862,618 | 9/1989 | Szabo | 42/7 |
| 5,293,708 | 3/1994 | Strayer | 42/75.03 |
| 5,386,657 | 2/1995 | Racheli | 42/50 |

OTHER PUBLICATIONS

Guns & Ammo, "Eaton", Jul. 1983, p. 20.

American Rifleman, "Eagle", Jun. 1985, p. 58.

Lewis, Jack, "The Gun Digest Book of Modern Gun Values", ninth edition, DBI Books, Inc., pp. 60–61.

*Primary Examiner*—Stephen C. Bentley

*Attorney, Agent, or Firm*—Stephen Donovan

[57] ABSTRACT

A firearm, such as a pistol, capable of accepting into its' magazine well either a narrow body (single cartridge row) or a wide body (double cartridge row) magazine is disclosed. The magazine well within the pistol's grip is bevelled to receive a bevelled wide body magazine. The magazine well has at least three contact points for contacting, aligning, and securely positioning a narrow body magazine within the grip. A firearm embodying the present invention can be a .45 ACP, semiautomatic, 1911 government model style pistol.

17 Claims, 5 Drawing Sheets

10
17
12
34
14
2
2

26
30
28
16

18
22
20
22

14
22
16
12

14
20

Fig. 7
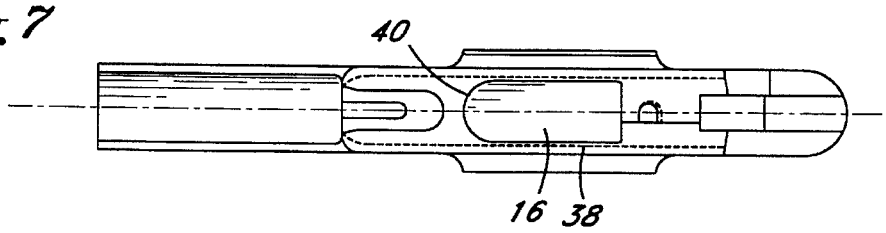
Fig. 6
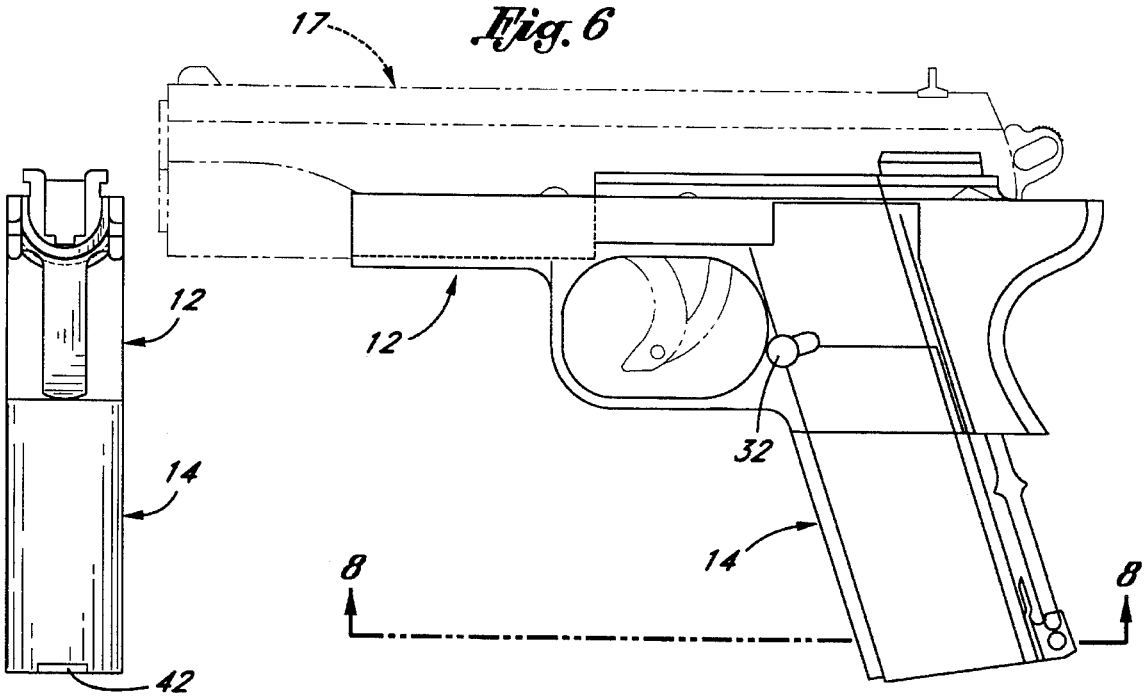
Fig. 9
Fig. 8
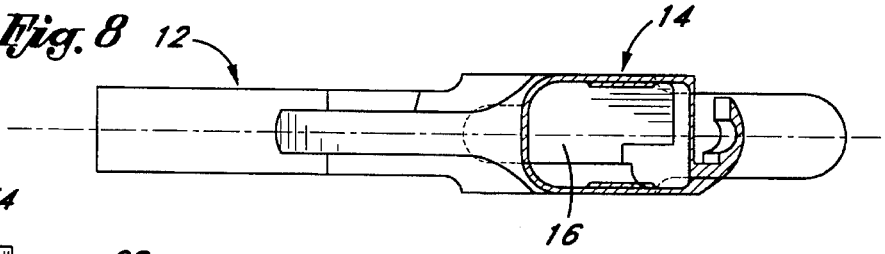
Fig. 10
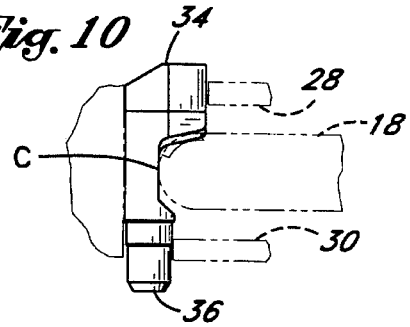

FIREARM CAPABLE OF OPERATION WITH DIFFERENT CAPACITY MAGAZINES

BACKGROUND

The present invention relates to a firearm capable of accepting different cartridge capacity magazines. In particular, the present invention relates to a handgun capable of operation in conjunction with either a narrow body or a wide body magazine.

A firearm is a manufacture capable of expelling a projectile towards a target upon ignition of a primer located behind the projectile (commonly referred to as a bullet) to generate a motive force. The projectile, the primer and a disposable casing housing the projectile and the primer comprise a cartridge. A firearm can be a rifle, shotgun, or a handgun. A handgun can be a pistol with a frame and a slide, or a revolver. A pistol is an automatic or semi-automatic firing handgun. The pistol frame can comprise a horizontal portion upon which the slide rests and a downwardly extending grip. The pistol grip and the part of the frame into which the grip merges can encompass an internal cavity or magazine (i.e. clip) well into which can be inserted a cartridge-containing magazine.

Both narrow body and wide body pistols are known. A narrow body magazine is inserted into the magazine well in the grip of a narrow body pistol. A wide body magazine is inserted into the magazine well in the grip of a wide body pistol. A narrow-body magazine holds a single row of cartridges. A wide-body magazine is loaded with two or more rows of cartridges, which stagger into a single row of cartridges near an upper magazine cartridge egress of the wide body magazine. Cartridges are typically held in and moved within a magazine due to compression of a spring located in the magazine. The cartridges exit from an open upper end of the magazine into the slide. The grooved slide fits over mating rails frame on opposite upper sides of the frame. Alternately, the slide can bear the rails and the frame can have the mating grooves.

Typically, a wide body pistol loaded with a wide body magazine is capable of firing more rounds before it needs to be reloaded, than can a narrow body pistol loaded with a narrow body magazine, where both pistols are using the same caliber of ammunition and the wide body magazine is the same length as the narrow body magazine.

A narrow body pistol can be compact, lightweight, inexpensive and easy to hold and use by a shooter with small and/or weak hands. A wide body pistol typically has a grip with a circumference greater than the circumference of the grip of a narrow body pistol for the same caliber of ammunition.

A narrow body magazine cannot be inserted into any known wide body pistol because the magazine well of a wide body pistol grip is too large to hold a narrow body magazine and/or the configuration of a narrow body magazine prevents its insertion into the magazine well of a wide body pistol.

Similarly, a wide body magazine cannot be inserted into the magazine well of a narrow body pistol at least because the magazine well of a narrow body pistol is too narrow to accept a wide body magazine.

U.S. Pat. No. 5,293,708 discusses a frame/handgrip assembly for autoloading handguns comprising a metal frame structure having guide rails for receiving a conventional slide and for receiving other standard 1911 A1 components. The frame structure defines an internal handgrip having one or more internal keys for establishing mating, interlocked structural relationships with opposed handgrip seats. The frame and handgrip structure may cooperatively define a wide internal magazine receptacle for receiving a wide staggered row, enhanced volume cartridge magazine.

U.S. Pat. No. 4,586,282 discusses a grip assembly having a pair of side grips and a heel grip. Each side grip has a plurality of inwardly directed projections arranged to conform to the outline of a frame. The heel grip includes a leaf spring and opposite lateral edges which engage the side grips in final assembly to lock the rear edges of the side grips against movement laterally outwardly from the frame.

U.S. Pat. No. 4,586,281 discusses a cartridge magazine for storing cartridges that may be used with different firearms. The cartridge magazine includes a number of different latch-related elements for use in engaging different cartridge magazine latching mechanisms found on each style of firearm. A positioning member located on the magazine assists alignment of the cartridges during loading into the firearm so that jamming of the cartridges is eliminated.

Thus, while narrow body pistols, wide body pistols and magazines which will fit into different firearms are known, there appears to be no known firearm which can accept and function with either a narrow body magazine or a wide body magazine. Hence, a need exists for a firearm capable of accepting and operating with either a narrow body or a wide body magazine.

SUMMARY

The present invention meets this need and provides a wide body firearm capable of accepting and operating with either a narrow body magazine or a wide body magazine.

A firearm within the scope of the present invention has a frame with an internal cavity. The internal cavity is adapted to receive different cartridge capacity magazines. The firearm has a downwardly projecting grip integral with the frame, and it is the grip and the frame which define the internal cavity. The internal cavity has two side walls and each side wall has, proceeding from a bottom to a top of the internal cavity, a first straight side wall portion, followed by a bevelled side wall portion, and finally a second straight side wall portion. The internal cavity side walls are not symmetrical.

The second straight side wall portions of each of the side walls of the internal cavity comprises a first means for contacting a magazine inserted into the internal cavity. The first contact means for contacting contacts an upper exterior surface of the magazine inserted into the internal cavity.

Additionally, the firearm grip has a side wall with a slot for receiving a second means for contacting a magazine inserted into the internal cavity in a releasable interlocking assembly. The second means for contacting contacts a middle or upper middle exterior surface of the magazine inserted into the internal cavity. The second means for contacting can be a magazine catch which extends through the slot, so that an interior surface of the magazine catch forms a contact area for a magazine inserted into the internal cavity of the grip.

Finally, the grip can have a third means for contacting a magazine inserted into the internal cavity. The third means for contacting can contact a lower exterior surface of the magazine inserted into the internal cavity. Specifically, the third means for contacting can comprise a connection receptacle or groove for receiving a connection projection or flange located at a bottom edge of a magazine in a forwardly supported interfitting relation therein.

Alternately stated, the firearm according can have an internal cavity with front, rear, first and second side walls, wherein the surfaces of the walls define in the internal cavity a magazine cartridge receptacle, and an exterior surface of a wide body magazine can be slidably engaged against the interior surfaces of the internal cavity walls.

A wide body magazine can be received within the internal cavity because the internal cavity has a top portion of a lesser width than the width of a lower portion of the internal cavity. The wide body magazine can have an outwardly projecting flange for engagement with a groove at the bottom of the grip. The wide body magazine can fit flush against a bottom wall of the grip.

Similarly, a narrow body magazine can be received within the internal cavity, even though the internal cavity has a top portion of a lesser width than the width of a lower portion of the internal cavity. The narrow body magazine can have an outwardly projecting flange for engagement with a groove at the bottom of the grip. The narrow body magazine can fit flush against a bottom wall of the grip.

Another embodiment of the present invention can be a firearm comprising a frame with a downwardly projecting grip integral with the frame, wherein an internal cavity is disposed within the grip and within a portion of the frame adjacent to the grip, the internal cavity being adapted to receive different cartridge capacity magazines and the internal cavity comprising two side walls, each side wall having, proceeding from a bottom to a top of the internal cavity, a first straight side wall portion, followed by a bevelled side wall portion, followed by a second straight side wall portion, the internal cavity side walls not being symmetrical, and wherein: (a) the second straight side wall portions of each of the side walls of the internal cavity comprises a first means for contacting a magazine inserted into the internal cavity, the first means for contacting contacts an upper exterior surface of the magazine inserted into the internal cavity; (b) the grip comprises a side wall with a slot for receiving a second means for contacting a magazine inserted into the internal cavity in a releasable interlocking assembly, wherein the second means for contacting contacts an upper middle exterior surface of the magazine inserted into the internal cavity; and (c) the grip also comprises a third means for contacting a magazine inserted into the internal cavity, wherein the third means for contacting contacts a lower exterior surface of the magazine inserted into the internal cavity, and the third means for contacting comprises a connection receptacle or groove for receiving a connection projection or flange located at a bottom edge of a magazine in a forwardly supported interfitting relation therein.

The pistol frame used to construct a disclosed pistol can have an internal cavity adapted to hold different cartridge capacity magazines, and the pistol frame can comprise: (a) a horizontally extending upper portion and a downwardly extending lower or grip portion, the frame comprising near or at the intersection of the upper and lower frame portions a first contact and alignment means for contacting and aligning a top portion of a magazine in the internal cavity; and (b) the grip integral with the frame member, comprising the internal cavity, wherein the internal cavity has front, rear, and side walls, interior surfaces of these walls defining a magazine cartridge receptacle, the grip further comprising a slot located in a side wall, the slot being of such shape and position as to be capable of receiving a second contact means comprising a magazine catch for contacting and retaining different cartridge capacity magazines within the interior cavity of the grip in a releasable interlocking assembly; and the grip comprising a third contact and positioning means disposed at a lower front side wall of the grip for establishing further contact and alignment of a magazine within the interior cavity of the grip and the frame member.

A contact and alignment means of the pistol frame member can be of such shape and position to substantially prevent or reduce cartridges upon ejection from the magazine having misalignment whereby the cartridge is thereby substantially prevented from becoming jammed in the pistol frame.

A further embodiment of the present invention can be a firearm adapted to receive and to operate with different cartridge capacity magazines, the firearm can have a slide mounted on a frame: the frame comprising a horizontally extending upper portion and a downwardly extending lower portion or grip, the frame having: (i) the pistol frame comprising an interior cavity having front, rear, first and second side walls, interior surfaces of the side walls defining a magazine cartridge receptacle, wherein upper internal cavity walls define a first means for contacting a magazine inserted into the internal cavity; (ii) the pistol frame comprising second means for contacting a magazine inserted into the internal cavity by defining a slot located in the first side wall, the slot being of such shape and position as to be capable of receiving a magazine catch for contacting and retaining the magazine within the interior cavity of the grip in a releasable interlocking assembly; and (iii) the pistol frame comprising a third contact means comprising a groove located at a lower edge of the front wall of the grip having such shape and position as to be capable of receiving an outwardly projecting flange located at a bottom edge of the plurality of styles of magazine cartridges, wherein the groove in cooperation with the flange contacts and aligns the magazine within the interior cavity of the grip.

A firearm frame/grip assembly for use with different size magazines comprises a frame member having a generally rectangular opening in registry with a curved recess and a grip integral with the frame member wherein the grip defines a magazine cartridge receptacle for receiving different size magazines and having a slot located to be capable of receiving a magazine catch for retaining the magazine cartridges.

Additionally, the grip defines a groove located at a lower edge of the grip for receiving an outwardly projecting flange located at a bottom edge of the different size magazines for further alignment and attachment of the different size magazines within the magazine cartridge receptacle of the grip.

The firearm frame/grip assembly defines a large dimensioned internal magazine cartridge receptacle which merges with the cartridge magazine receptacle of the frame member and permits insertion of large capacity, staggered row magazine cartridges and single row magazine cartridges into the frame/grip assembly.

DRAWINGS

The above, as well as other, advantages of the present invention will become apparent to those skilled in the art from the following description and the drawings.

FIG. 1 is a left side elevational view of an embodiment constructed according to the present invention in the form of a .45 ACP semiautomatic pistol, illustrated as an exploded view showing a wide body magazine about to be inserted into the magazine well of the grip of the pistol, and showing in phantom a cartridge about to egress from the wide body magazine. Also shown as a phantom rectangle on the wide body cartridge is the area of contact on the magazine by a magazine catch;

FIG. 3 is a bottom elevational view taken along line 2—2 of FIG. 1, but showing the narrow body magazine illustrated in FIG. 4 inserted into the magazine well of the FIG. 1 pistol, and showing the bottom of the single row of cartridges in phantom;

FIG. 6 is a left side view of the frame of the FIG. 1 pistol with grip covers, magazine catch, thumb safety and slide lock removed, and showing the slide, hammer, sights and trigger in phantom;

FIG. 7 is a top view of the FIG. 6 pistol frame;

FIG. 8 is a cross-sectional view taken along the line 8—8 of FIG. 6;

FIG. 9 is a front view of the pistol frame;

FIG. 10 is a plan view of a magazine catch inserted into a slot in the grip, showing the internal cavity side walls and a narrow body magazine inserted into the internal cavity in phantom;

DESCRIPTION

The present invention is based upon the discovery that a firearm can be made to securely hold and operate with either a narrow body magazine or a wide body magazine. Essential to this invention is an appropriate configuration to an internal grip cavity to permit reception and retention of either a low cartridge capacity, narrow body magazine, or a high cartridge capacity, wide body magazine.

Retention of a narrow body magazine in the magazine of the disclosed wide body pistol is accomplished by having at least three contact areas where the narrow body magazine is held in the magazine well. A wide body magazine is held in the wide body magazine at the three contact areas and at additional contact areas, as the bevelled wide body magazine fits into the bevelled wide body pistol magazine well, somewhat (and by analogy) as a hand fits into a glove.

The attached drawings show a preferred embodiment (or magazines or other ancillary components) of the present invention as .45 ACP modified "government model" semi-automatic pistol or handgun. Preferably, the grip angle, that is the angle formed between the horizontally extending upper frame (upon which is placed a slide) and the downwardly extending grip is identical to the grip angle of the Browning or Colt™ government model .45 ACP. The present invention is not applicable to revolving cartridge chamber firearms, which firearms are often referred to as revolvers.

The handgun shown by the attached Figures can also comprise a revolver type side plate containing the trigger action parts. At least three different action and interchangeable modules or trigger side plates can be attached to the handgun, permitting: (1) single action only; (2) double action only; or (3) double action and single action. In double action, about 12 lbs of pull are required to operate the trigger. In the single action mode, about 3 lbs of pull are required to operate the trigger.

As illustrated by the attached drawings, a firearm 10 within the scope of the present invention comprises a frame 12 and a downwardly projecting grip 14 integral with the frame 12. The grip 14 is integral with the frame member 12 by any suitable attachment means such as by screws, bolts and by casting the grip as one part with the frame.

Figure 11:
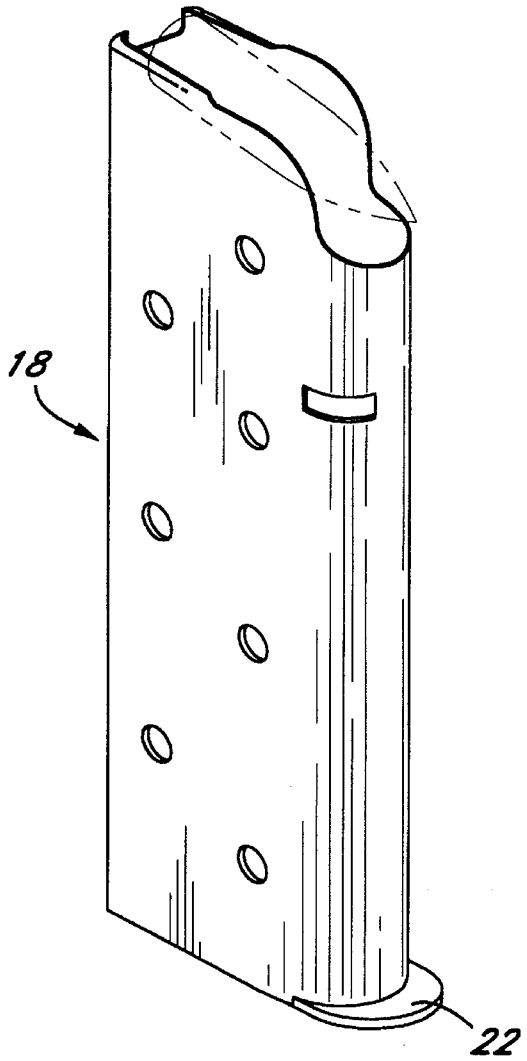
FIG. 11 is a perspective view of a narrow body magazine with a cartridge shown in phantom.
Figure 12:
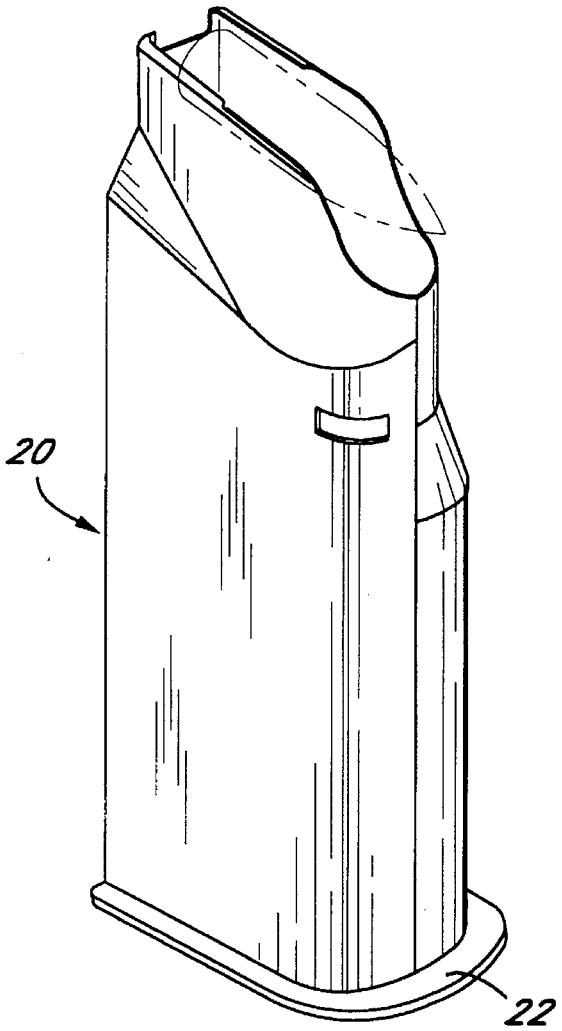
FIG. 12 is a perspective view of a wide body magazine with a cartridge shown in phantom.

The grip 14 defines an internal cavity 16. The internal cavity extends throughout the length of the grip 14 and continues to the top of the grip, where the top of the grip (or upper frame) is attached for reciprocating movement to a slide 17. The internal cavity 16 is configured to receive and to securely hold in place throughout a firing cycle a single magazine fully loaded with cartridges. Thus, internal cavity 16 functions as a magazine receptacle. The magazine which can be inserted into the internal cavity 16 can be either a narrow body magazine 18 or a wide body magazine 20. Thus, internal cavity 16 is sufficiently wide to accept either a wide body magazine 20, and has sufficient contact points or areas to securely hold in place a narrow body magazine 18. A wide body magazine typically holds two rows of staggered cartridges. One cartridge exits at a time from either a narrow body or a wide body magazine, as illustrated by FIGS. 11 and 12.

A preferred embodiment of the present invention is a .45 ACP semiautomatic pistol. The internal cavity of such an embodiment of the present invention can hold a seven round narrow body magazine, an eight round narrow body magazine, a ten round wide body magazine and a thirteen or fourteen round wide body magazine. Each of these five types of magazine can fit within the internal cavity with only a horizontally extending flange 22 protruding from the internal cavity. Thus, upon insertion into the internal cavity of any one of the five indicated capacity magazines, the base plates of all five of these types of magazines fits flush with the bottom of the grip.

Figure 17:
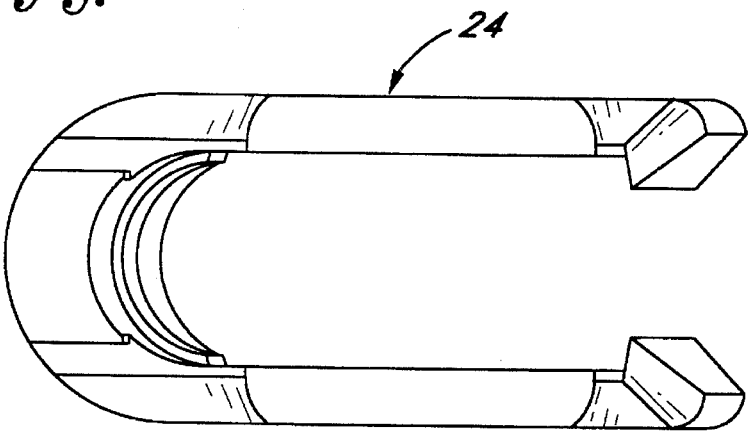
FIG. 17 is a top elevational view of skirt or bumper for attachment to an extended length magazine.
Figure 18:
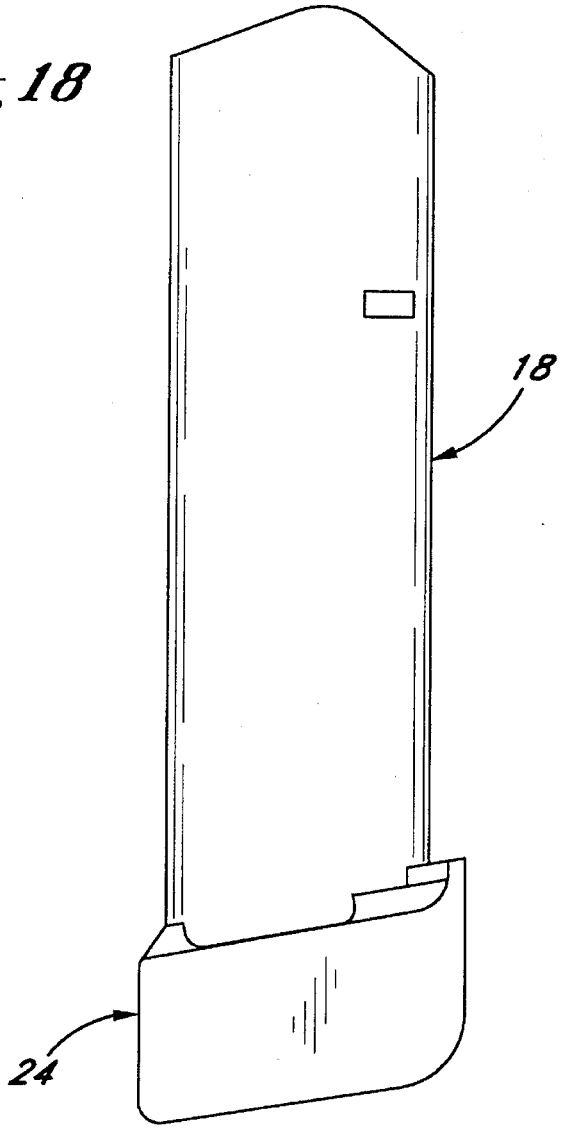
FIG. 18 is side view of the magazine skirt of FIG. 17 inserted in place over the portion of a narrow body magazine which extends outside the internal cavity of the pistol illustrated by FIG. 1.

The .45 ACP semiautomatic pistol embodiment of the present invention can also have loaded into the internal cavity 16 a ten round narrow body, and a sixteen or seventeen round wide body magazine. Each of these types of magazines has a lower magazine portion which protrudes downwards from the end of the internal grip cavity 16. The portion of these three magazine types which extends beyond and out of the internal cavity 16 can be covered by a base skirt 24. Application of the base skirt 24 over the exterior of a narrow body magazine (after rotating the base skirt shown in FIG. 17 by 180°) is illustrated by FIG. 18. Preferably, the base skirt 24 is made of a hard plastic material to facilitate easy construction and a facile snap-on application over the base lower portion of an extended length magazine.

Significantly, the internal cavity 16 of the .45 ACP semiautomatic pistol embodiment of the present invention can be loaded with, can securely retain in position in the internal cavity and can be repeatedly operated (i.e. fired) with any one of the eight magazines types described in the two preceding paragraphs. Each of the three narrow body (single column) magazines described has the same width. Each of the five wide body (double column) magazines described also has the same width.

The exterior surfaces of the wide body magazine 20 can be slidably engaged against the interior surfaces of the internal cavity wall and securely held at multiple contact points in a firing position with the interior cavity 16. A narrow body magazine 18, upon insertion into the interior cavity 16, is also securely held in the internal cavity, although at fewer contact points.

Figures 1, 2, 3, 4, 5:
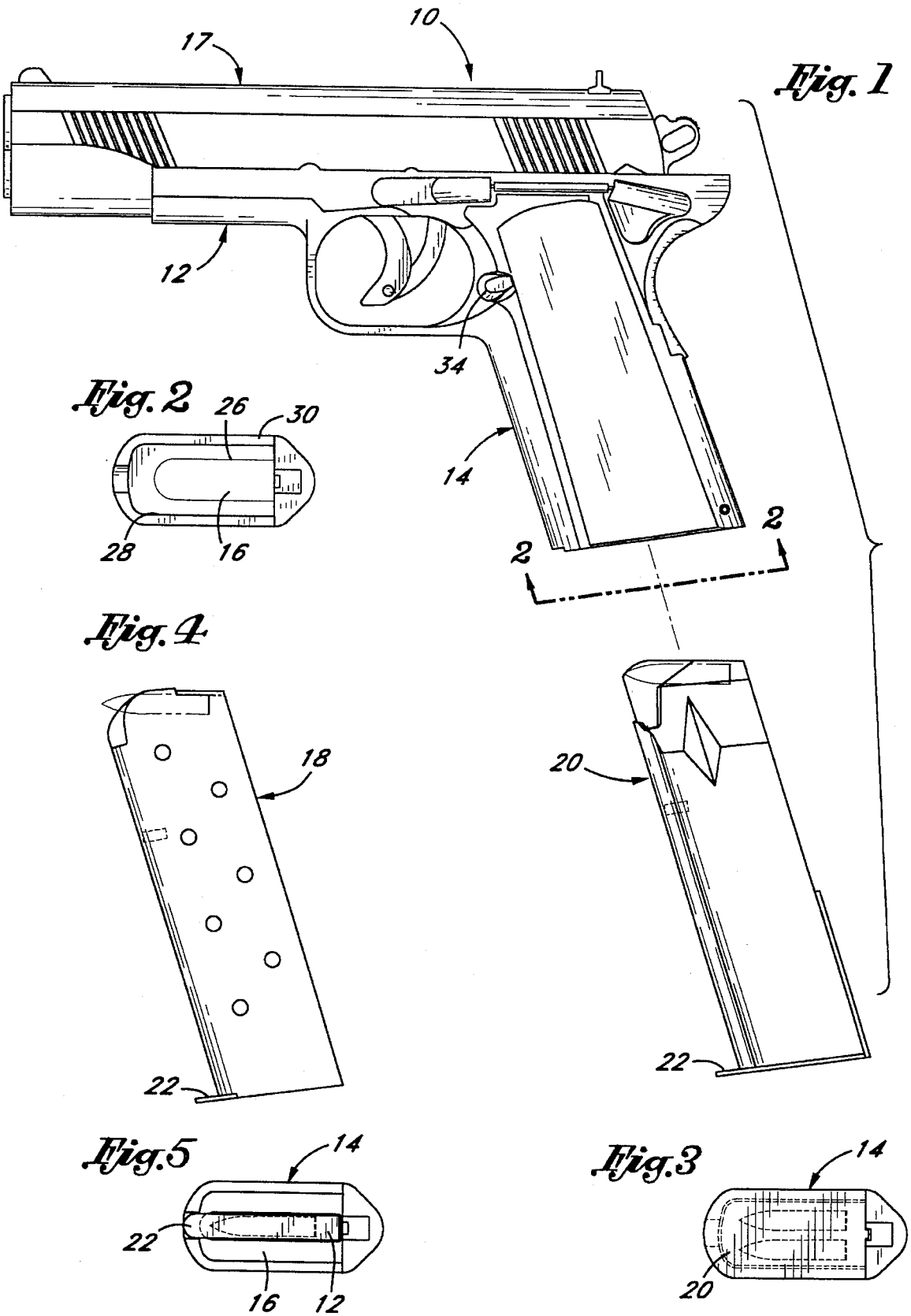
FIG. 2 is an bottom elevational view taken along line 2—2 of FIG. 1 showing the empty internal grip cavity or magazine well.
FIG. 3 is a bottom elevational view taken along line 2—2 of FIG. 1, but showing the wide body magazine illustrated in FIG. 1 inserted into the magazine well of the FIG. 1 pistol, and showing the bottom of the two rows of cartridges in phantom.
FIG. 4 is a side view of a narrow body magazine showing in phantom a cartridge about to egress from the narrow body magazine. Also shown as a phantom rectangle on the narrow body cartridge is the area of contact on the magazine by a magazine catch.
FIG. 5 is

The internal cavity (or magazine well) 16 is bevelled to accommodate the bevelled configuration of the wide body magazine 20. The ellipse 26 (see FIG. 2) indicates that the internal cavity becomes somewhat constricted towards the upper end of the internal cavity 16, due to the bevelling feature. A very important feature of the present invention is the novel configuration of the interior cavity 16. This configuration assists secure retention of either a narrow body or a wide body magazine within the interior cavity 16.

Figure 13:
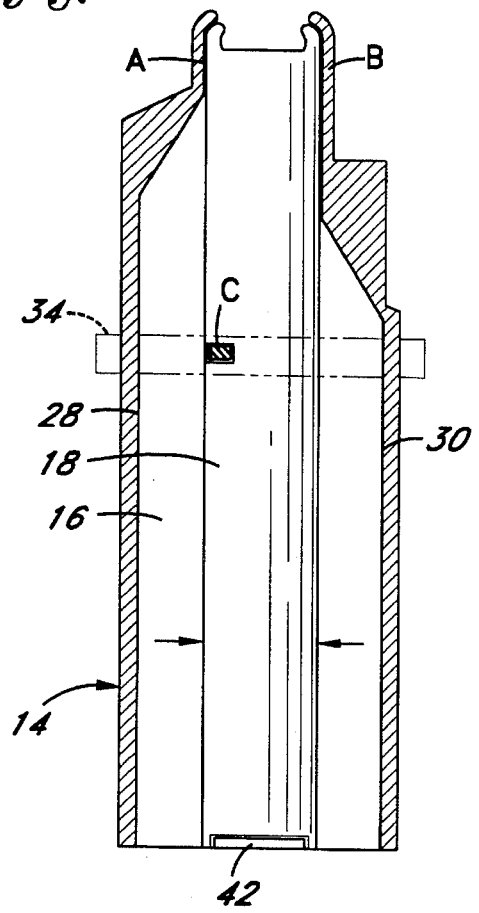
FIG. 13 is a front cross sectional view of the pistol frame showing a narrow body magazine fully inserted into the internal cavity or magazine well, where the opposing arrows shown in the Figure indicate the position of the narrow body magazine in the internal cavity, and a magazine catch is shown in phantom.

The interior cavity 16 (also referred to as a magazine well or as a magazine receptacle) comprises a side wall 28 and a side wall 30. The exterior of walls 28 and 30 form the exterior of the grip and the frame side walls, because the interior cavity 16 is enclosed by the grip and by the section of the frame into which the grip extends. The internal cavity side wall 28 has, proceeding from the bottom to the top of the grip, a lower straight portion, a bevelled wall portion whereby the internal cavity side wall is inclined inwards, followed by a second straight portion of the side wall 28. The second straight portion of side wall 28 is shorter than the first straight portion of side wall 28. Internal cavity side wall 30 also has, proceeding from the bottom to the top of the grip internal cavity 16, a first straight portion, followed by a bevelled side wall 30 portion (whereby the internal cavity side wall is inclined inwards), and a second straight portion of the side wall 30. Side walls 28 and 30 are not symmetrical, as the bevelled portion of side wall 28 occur higher up towards the top of the internal cavity, than it does for side wall 30. Additionally, the second straight portion of the side wall 30 is longer than the second straight portion of the side wall 28. The bevelled configuration permits insertion and retention of a bevelled wide-body magazine. A wide body magazine is typically bevelled, so as to cause the two rows of cartridges in a wide body magazine to exit from the wide body magazine one at a time. The non-symmetrical configuration of the side wall 28 and 30 of the internal cavity 30 greatly facilitates retention of a narrow body magazine 18 in the internal cavity 16. Thus, and as shown best by FIG. 13, the non-symmetrical nature of side walls 28 and 30 permits a greater area of contact (at the highlighted areas A and B—see FIG. 13) with a narrow body magazine 18 at the upper end of the internal cavity 16 than would be possible with a symmetrical, that is opposite and equal length bevelled wall area of the internal cavity 16 side walls 28 and 30. As shown by the extensive highlighted area in FIG. 15 (essentially all of the side wall 28 and 30), the wide body magazine 20 has far greater contact area with the internal cavity side wall than does the narrow body magazine 18 in the same internal cavity 16.

Configuring the internal cavity 16 side wall 28 and 30 in a non-symmetrical manner has an added advantage. I have found that the unique configuration of the wide body magazine which is required in order to permit a wide body magazine to fit into and to be retained by the internal cavity significantly facilitates a rapid staggering and jam-free upward movement of the cartridges up and out of the wide body magazine 20 during the firing cycle. This concomitantly reduces the risk of misfires and/or of a cartridge jamming in the firearm. Known symmetrically bevelled wide body magazines of the prior art will not fit into and/or cannot be retained within the internal cavity 16.

Referring to FIG. 6, the grip 14 defines a slot 32 in either side wall 28 or 30, having a shape and position adapted to receive a magazine catch 34. Upon insertion into slot 32, an interior surface wall (highlighted arcuate area C in FIGS. 10, 13 and 15) of magazine catch 30 acts as a contact area for both a narrow body magazine 18 and a wide body magazine 20 inserted into the internal cavity 16. Depressing side 36 of the magazine catch 34 causes a release of area C from contact with a magazine. Thus, magazine catch 34 provide a means for retaining the narrow body and wide body magazines within the interior cavity 16 of the grip 14 in a releasable interlocking assembly.

Referring now to FIG. 7, an uppermost area of frame 12 defines an alignment chamber 38 having a shape and position to substantially prevent or reduce cartridges upon ejection from the magazine from being misaligned and additionally prevents the cartridge from being jammed in the firearm 10. The alignment chamber 38 is generally rectangular and has a curved recess 40. The rectangular shape of the alignment chamber 38 and the curved recess 40 are utilized to guide a cartridge into a cartridge chamber of the slide 17 which fits upon rails on the upper frame of the firearm 10.

A lowermost portion of a front grip wall defines a connection receptacle or groove 42 located which has a shape and position adapted for receiving the outwardly projecting magazine flange 22 located at a bottom edge of both the narrow body and wide body magazines which can be inserted into the internal cavity 16. Thus, flange 22 upon insertion and retention by groove 42 provides a third area of contact (and hence also of retention and alignment) in a forwardly supported interfitting relation between the grip 14 and either a narrow body magazine 18 or a wide body magazine 20 appropriately inserted into the internal cavity 16. Hence, the projecting magazine flange 22 wherein engagement with the groove 42 provides an additional degree of alignment permitting a narrow body magazine 18 to be held in the internal cavity flush with the bottom of the grip. A wide body magazine can also have a flange 22 for the same purpose a narrow body magazine 18 can have a flange.

Figure 15:
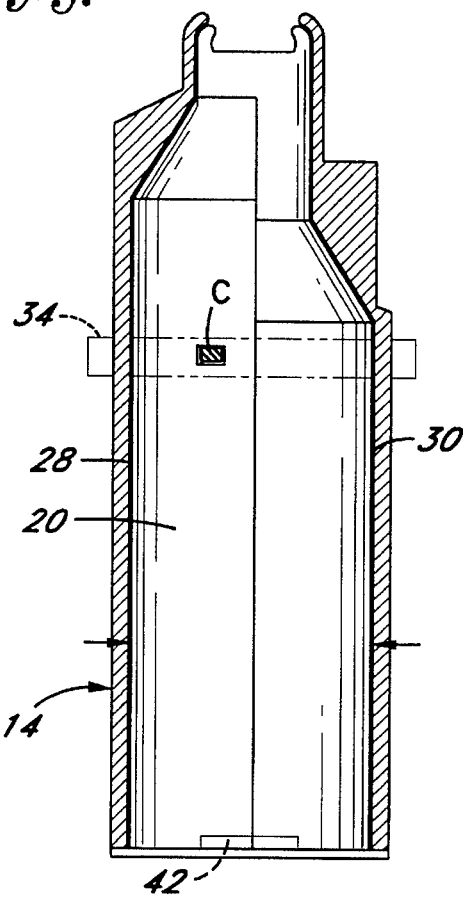
FIG. 15 is a front cross sectional view of the pistol frame showing a wide body magazine fully inserted into the internal cavity or magazine well, where the opposing arrows shown in the Figure indicate the position of the wide body magazine in the internal cavity, and a magazine catch is shown in phantom.
Figure 14:
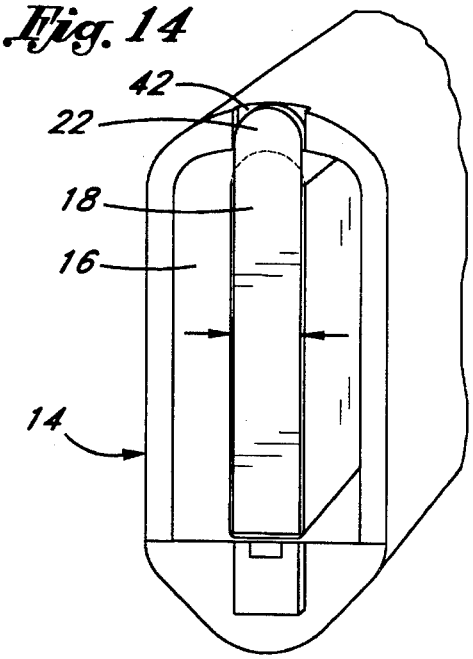
FIG. 14 is a bottom perspective view of the pistol frame showing a narrow body magazine inserted into the internal cavity.
Figure 16:
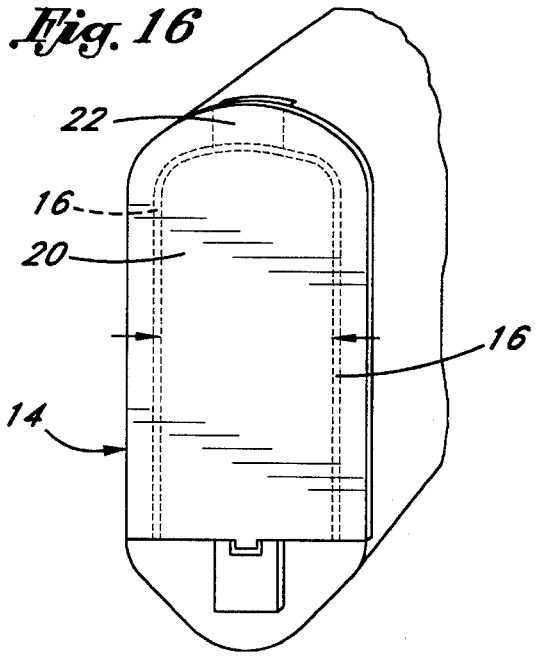
FIG. 16 is a bottom perspective view of the pistol frame showing a wide body magazine inserted into the internal cavity.

But whereas the flange 22 and grip groove 42 provides one of only three contact area between a narrow body magazine 18 and grip or the walls of the internal cavity 16, a wide body magazine has many additional areas of contact with the walls of the internal cavity 16, as shown best by FIG. 15. Thus, for a narrow body magazine 18, the flange 22 and groove 42 interaction effect to facilitates a proper alignment in and retention by the internal cavity of a narrow body magazine is more pronounced, as compared to this effect upon a wide body magazine 20.

Thus, a narrow body magazine 18 is held in the internal cavity 16 by: (1) upper internal cavity 16 contact areas A and B; (2) flange 22 and groove 42 interaction; and (3) magazine catch 34 contact area C.

The outer side walls of the grip 14 can comprise a plurality of grooved surfaces or a roughened surface for enhancing manual gripping of the firearm 10 by a user during shooting.

After use of the firearm, a magazine, can be removed from the internal cavity 16 by depressing the magazine catch 34, thereby sufficiently loosening the inserted magazine for it to be gravity released or easily pulled from the magazine well. The magazine thus removed may be reloaded or replaced by a preloaded magazine reinserted into the same style of firearm or inserted into another of the plurality of firearms to which the cartridge magazine may be adapted for.

The frame 12, grip 14 and slide 17 of the firearm 10 can be constructed of any suitable material, although stainless steel is a preferred material because it is durable, resists heat and corrosion, can withstand abusive weather and service conditions, and is amenable to computer numerical control (CNC) machining. More preferably, the material used to construct the frame/grip assembly 10 is 17-4ph stainless steel because such material provides the aforementioned characteristics and is readily available.

The firearm can also comprise a heavy bull barrel/slide; a full length guide rod recoil buffer assembly; an extended ambidextrous safety; and an extended slide lock.

The disclosed invention has many advantages including the following:

1. A .45 ACP automatic or semiautomatic pistol capable of operation with:
   (1) a seven round narrow body magazine which fits flush with the bottom of the grip;
   (2) an eight round narrow body magazine which fits flush with the bottom of the grip;
   (3) a ten round wide body magazine which fits flush with the bottom of the grip;
   (4) a thirteen round wide body magazine which fits flush with the bottom of the grip;
   (5) a fourteen round wide body magazine which fits flush with the bottom of the grip;
   (6) a ten round narrow body skirted magazine, wherein the magazine skirt (also referred to as a magazine base skirt or as a magazine bumper) fits over the portion of the magazine which protrudes from the bottom of the grip;
   (7) a sixteen round wide body skirted magazine; and
   (8) a seventeen round wide body skirted magazine is disclosed.
2. A user of the disclosed firearm is not required to make a selection among different capacity magazines before inserting either a narrow body or a wide body magazine into a firearm constructed according to the disclosed invention.
3. A user is relieved of the necessity of maintaining a number of different styles of firearms. Additionally, due the aforedescribed assembly, the magazine cartridges are insertable into the firearm in a smooth non-binding manner, while excessive insertion is prevented. Also, jamming is prevented of the cartridges by the configuration of the frame members' alignment chamber.

I claim:

1. A pistol which operates with either a narrow body magazine or with a wide body magazine, the pistol comprising:

(a) a frame with an internal cavity, the internal cavity having two side walls, each side wall of the internal cavity having, proceeding from a bottom to a top of the internal cavity;
   (i) a first straight side wall portion, the first straight side wall portion of each of the two side walls of the internal cavity being of unequal length, the first straight side wall portion being followed by,
   (ii) a bevelled side wall portion, followed by,
   (iii) a second straight side wall portion, and
(b) a downardly projecting grip integral with the frame, and;
(c) a slide mounted on the frame, whereby the pistol operates with either a narrow body magazine or a wide body magazine.

2. The pistol of claim 1, wherein the second straight side wall portions of the two side walls of the internal cavity are of unequal length.

3. The pistol of claim 1, further comprising a downwardly projecting grip integral with the frame, the grip and the frame defining the internal cavity.

4. The pistol of claim 3, wherein the second straight side wall portions of each of the side walls of the internal cavity comprises a first means for contacting a magazine inserted into the internal cavity.

5. The pistol of claim 4, wherein the first means for contacting contacts an upper exterior surface of the magazine inserted into the internal cavity.

6. The pistol of claim 4, wherein the grip comprises a side wall with a slot for receiving a second means for contacting a magazine inserted into the internal cavity in a releasable interlocking assembly.

7. The pistol of claim 6, wherein the second means for contacting contacts a middle exterior surface of the magazine inserted into the internal cavity.

8. The pistol of claim 7, wherein the second means for contacting contacts an upper middle exterior surface of the magazine inserted into the internal cavity.

9. The pistol of claim 8, wherein the second means for contacting comprises a magazine catch which extends through the slot.

10. The pistol of claim 9, wherein the side wall defines the slot for receiving the magazine catch, and an interior surface of the magazine catch forms a contact area for a magazine inserted into the internal cavity of the grip.

11. The pistol of claim 6, wherein the grip comprises a third means for contacting a magazine inserted into the internal cavity.

12. The pistol of claim 11, wherein the third means for contacting contacts a lower exterior surface of the magazine inserted into the internal cavity.

13. The pistol of claim 12, wherein the third means for contacting comprises a connection receptacle or groove for receiving a connection projection or flange located at a bottom edge of a magazine in a forwardly supported interfitting relation therein.

14. A pistol for operating with either a narrow body magazine or a wide body magazine, the pistol comprising a frame with a downwardly projecting grip integral with the frame, wherein an internal cavity is disposed within the grip and within a portion of the frame adjacent to the grip, the internal cavity can receive different cartridge capacity magazines and the internal cavity comprising two side walls, each side wall having, proceeding from a bottom to a top of the internal cavity, a first straight side wall portion, followed by a bevelled side wall portion, followed by a second straight side wall portion, wherein the first straight side wall portions of the two side walls of the internal cavity are of unequal length and wherein:

(a) the second straight side wall portions of each of the side walls of the internal cavity comprises a first means for contacting a magazine inserted into the internal cavity, the first means for contacting contacts an upper exterior surface of the magazine inserted into the internal cavity;

(b) the grip comprises a side wall with a slot for receiving a second means for contacting a magazine inserted into the internal cavity in a releasable interlocking assembly, wherein the second means for contacting contacts an upper middle exterior surface of the magazine inserted into the internal cavity; and (c) the grip also comprises a third means for contacting a magazine inserted into the internal cavity, wherein the third means for contacting contacts a lower exterior surface of the magazine inserted into the internal cavity, and the third means for contacting comprises a connection receptacle or groove for receiving a connection projection or flange located at a bottom edge of a magazine in a forwardly supported interfitting relation therein, whereby the pistol operates with either a narrow body magazine or with a wide body magazine.

15. A pistol frame for a pistol for operating with either a narrow body magazine or a wide body magazine comprising an internal cavity for holding different cartridge capacity magazines, the pistol frame comprising:

(a) a horizontally extending upper portion and a downwardly extending lower or grip portion, the frame comprising near or at the intersection of the upper and lower frame portions a first contact and alignment means for contacting and aligning a top portion of a magazine in the internal cavity; and (b) the grip integral with the frame member, comprising the internal cavity, wherein the internal cavity has front, rear, and side walls, each side wall of the internal cavity having a first straight side wall portion, the first straight side wall portions of the side walls of the internal cavity being of unequal length, interior surfaces of the internal cavity walls defining a magazine cartridge receptacle, the grip further comprising a slot located in a side wall, the slot receiving a second contact means comprising a magazine catch for contacting and retaining different cartridge capacity magazines within the interior cavity of the grip in a releasable interlocking assembly; and the grip comprising a third contact and positioning means disposed at a lower front side wall of the grip for establishing further contact and alignment of a magazine within the interior cavity of the grip and the frame member, whereby the pistol frame is for a pistol for operating with either a narrow body magazine or a wide body magazine.

16. The pistol frame according to claim 15, wherein the first contact and alignment means of the pistol frame member is of such shape and position to substantially prevent or reduce cartridges upon ejection from the magazine having misalignment whereby the cartridge is thereby substantially prevented from becoming jammed in the pistol frame.

17. A pistol for operating with either a narrow body magazine or a wide body magazine, the pistol comprising:

(a) a slide mounted on a frame:

(b) the frame comprising a horizontally extending upper portion and a downwardly extending lower portion or grip, the frame having:

(i) the pistol frame comprising an interior cavity having front, rear, first and second side walls, each of the first and second side walls of the internal cavity having a first straight side wall portion, the first straight side wall portions of the side walls of the internal cavity being of unequal length, interior surfaces of the side walls defining a magazine cartridge receptacle, wherein upper internal cavity walls define a first means for contacting a magazine inserted into the internal cavity;

(ii) the pistol frame comprising second means for contacting a magazine inserted into the internal cavity by defining a slot located in the first side wall, the slot receiving a magazine catch for contacting and retaining the magazine within the interior cavity of the grip in a releasable interlocking assembly; and (iii) the pistol frame comprising a third contact means comprising a groove located at a lower edge of the front wall of the grip for receiving an outwardly projecting flange located at a bottom edge of the plurality of styles of magazine cartridges, wherein the groove in cooperation with the flange contacts and aligns the magazine within the interior cavity of the grip, whereby the pistol operates with either a narrow body magazine or a wide body magazine.

* * * * *